US006766753B2

(12) United States Patent
Pierson

(10) Patent No.: US 6,766,753 B2
(45) Date of Patent: Jul. 27, 2004

(54) PRE-FEEDER FOR A MAIN SAIL

(76) Inventor: Hank E Pierson, 132 Azalea Way, Eureka, CA (US) 95503

( * ) Notice: Subject to any disclaimer, the term of this patent is extended or adjusted under 35 U.S.C. 154(b) by 0 days.

(21) Appl. No.: 10/102,550

(22) Filed: Mar. 19, 2002

(65) Prior Publication Data

US 2002/0195038 A1 Dec. 26, 2002

Related U.S. Application Data

(60) Provisional application No. 60/277,458, filed on Mar. 20, 2001.

(51) Int. Cl.[7] ..... B63H 9/04

(52) U.S. Cl. ..... 114/106

(58) Field of Search ..... 114/104, 105, 114/106, 218, 381; 24/115 R, 132 R, 133, 135 R

(56) References Cited

U.S. PATENT DOCUMENTS

| | | | | | |
|---|---|---|---|---|---|
| 559,843 | A | * | 5/1896 | Cahoon | 114/105 |
| 3,759,210 | A | | 9/1973 | Davis | |
| 3,948,200 | A | * | 4/1976 | Hood et al. | 114/105 |
| 4,126,095 | A | * | 11/1978 | Tillery | 410/96 |
| 4,236,475 | A | | 12/1980 | Merry | |
| 4,340,005 | A | * | 7/1982 | Lagerquist | 114/105 |
| 4,352,336 | A | * | 10/1982 | Tostado | 114/218 |
| 4,619,216 | A | | 10/1986 | Crear, III et al. | |

* cited by examiner

*Primary Examiner*—Stephen Avila
(74) *Attorney, Agent, or Firm*—Kolisch Hartwell, P.C.

(57) ABSTRACT

A releasable pre-feeder guides a luft rope of a main sail into a groove in a mast.

14 Claims, 2 Drawing Sheets

Fig. 1
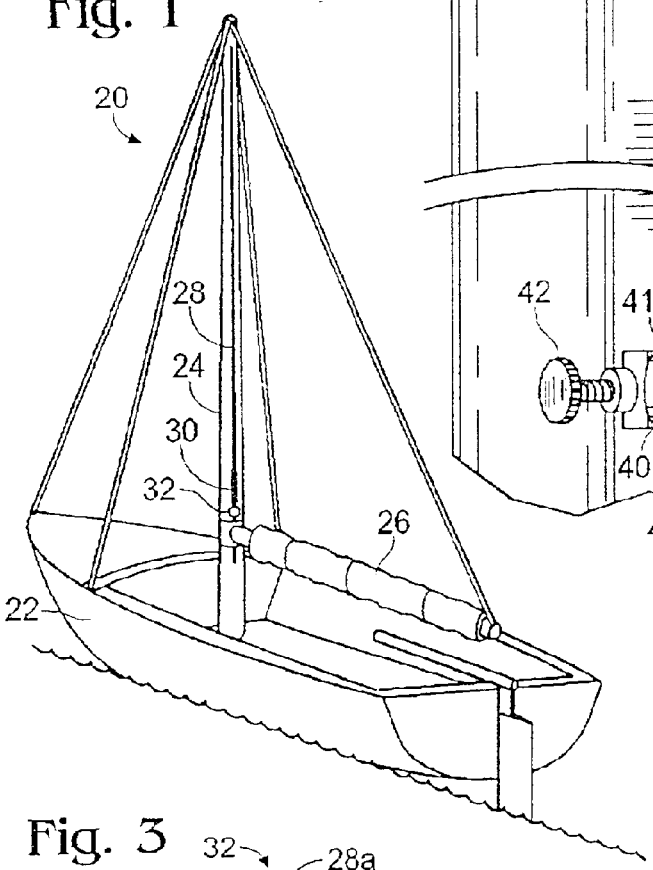
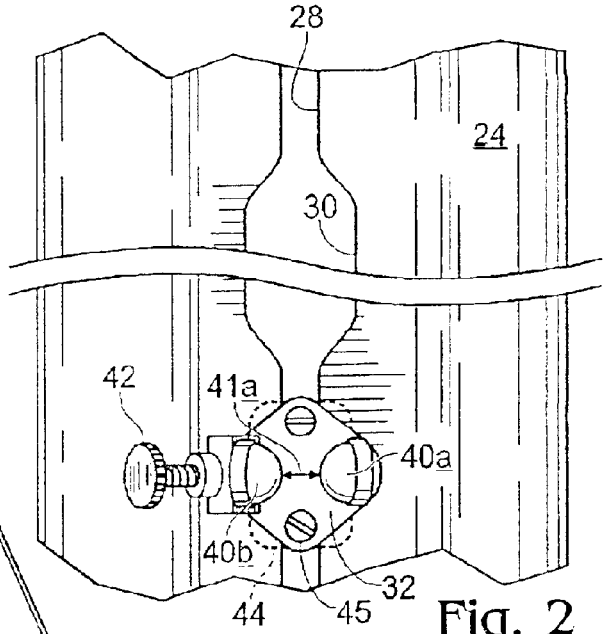
Fig. 2
Fig. 3
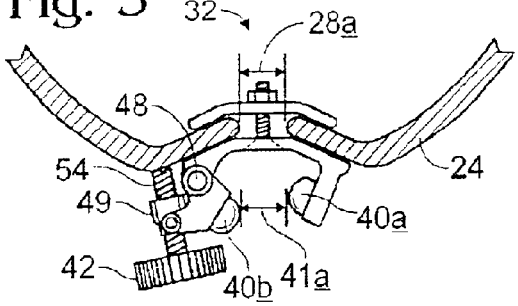
Fig. 4
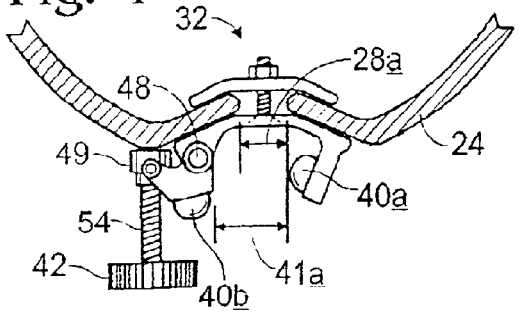
Fig. 5
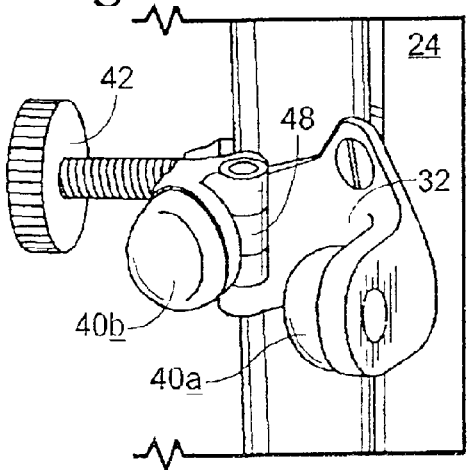

PRE-FEEDER FOR A MAIN SAIL

This application claims the benefit of Provisional application No. 60/277,458 filed Mar. 20, 2001.

FIELD OF THE INVENTION

The invention relates to sailing. In particular, the invention involves a pre-feeder for a main sail that can be easily switched between a gripping position and an open position. The invention provides a releasable clamp device that can be secured to a mast for guiding a luft rope into the groove of a mast.

BACKGROUND OF THE INVENTION

A pre-feeder guides a luft rope into a slot running the full height of the mast. The luft rope is a rope that is snugly sewn into the hem of the forward edge of a main sail. The luft rope edge runs the full length of the sail. The luft rope is completely inside the mast when sailing. This is why a main sail appears to be coming out of the mast. A pre-feeder is typically located below the entrance to the groove in the mast.

Various pre-feeder designs have been used in the past to guide a luft rope into the slot of a mast. For example, some pre-feeders are two piece, each piece being mounted on a side of the mast slot. These pre-feeders may be difficult to set to the proper opening dimension for a given luft rope. Other pre-feeders are one piece, with a fixed spacing between the guiding sides. The pre-set spacing of the pre-feeder may be inappropriate for some luft ropes. The pre-feeder may also set the guiding line of the luft rope too far away from the mast, thus causing the luft rope to pull out of the mast slot when pressure is exerted on the sail away from the mast groove or slot.

There are at least several problems with conventional pre-feeders that need to be addressed. First, existing pre-feeders do not allow the sail to be taken out of the pre-feeder once the sail is started up the mast, until the sail reaches the top. Only then can the bottom of the sail be pulled out of the pre-feeder. If wind is strong, the sailor may want the main sail to be only part way up. Later the sailor may need to take the main sail down quickly. With a conventional pre-feeder the sailor has two choices. The sailor may raise the sail to the top in order to free the luft rope from the mast groove, and then lower the sail quickly. Alternatively, the sailor may take the sail down directly, in which case the sail falls under gravity in the distance between the groove entrance on the mast and the pre-feeder, allowing the sail to fold out from the mast and onto the deck. The pre-feeder is then still holding the sail in such a way that the sail cannot be put back up without carefully guiding the fallen sail back down through the pre-feeder.

Another problem with conventional pre-feeders is that they cannot be adjusted to accommodate different luft rope dimensions. Luft ropes come in different dimensions, and the thickness of the sail material that forms the hem is variable. A pre-feeder must have an appropriate gap so that the sail may move freely through the pre-feeder, yet not allow the rope to squeeze out of the guides. A given pre-feeder may work well for a certain sail and luft rope configuration, but not work satisfactorily for a different luft rope and sail dimension. Accordingly, there is a need for a pre-feeder for a main sail where the gap defined by the pre-feeder can be easily adjusted between two or more positions to accommodate luft ropes and sails of different dimensions and/or to allow quick alternation between a released position and a gripping position.

SUMMARY OF THE INVENTION

The invention provides a pre-feeder for guiding a luft rope of a main sail into a groove in a mast. A clamp device is configured for mounting on a mast below the groove that receives the main sail. A clamp device defines a gap that is small enough to retain the luft rope inside the pre-feeder, yet large enough to permit easy sliding of the main sail through the pre-feeder. The pre-feeder has an adjustment mechanism that allows a sailor to alter the gap dimension.

BRIEF DESCRIPTION OF THE DRAWINGS

FIG. 1 is a perspective view of a sailboat.

FIG. 2 is a partial rear view of the mast on the sailboat shown in FIG. 1.

FIG. 3 is a perspective view of the pre-feeder shown in FIG. 2.

FIGS. 4 and 5 are cross-sectional views through the mast shown in FIG. 2, showing a pre-feeder in closed and opened positions, respectively.

DETAILED DESCRIPTION AND BEST MODE FOR CARRYING OUT THE INVENTION

Figure 6:
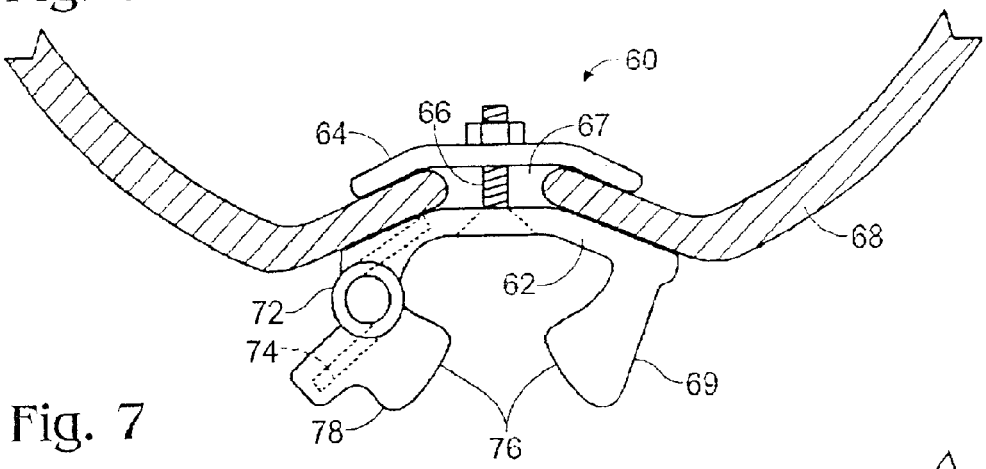
FIG. 6 shows a partial cross-sectional view of a mast and alternative pre-feeder embodiment.

The invention provides devices and methods for pre-feeding the luft rope of a main sail into a groove in a mast. The pre-feeder includes an adjustment mechanism that may be used to rapidly release or re-engage a luft rope for lowering or raising a main sail. A pre-feeder adjustment mechanism may also permit the pre-feeder to be altered and/or tuned to accommodate different dimensions of luft rope and sail materials.

FIG. 1 shows sail boat 20 including hull 22, mast 24, and main sail 26. Mast 24 has a groove 28 for receiving the forward edge of main sail 26. The forward edge of main sail 26 has a hem containing a luft rope which is received and retained inside groove 28 in mast 24. A widened groove region 30 is provided near the bottom of groove 28 in mast 24 for receiving the luft rope as it is hoisted up mast 24. Pre-feeder 32 is mounted on mast 24 below widened slot portion 30 for guiding the luft rope into widened slot portion 30 as main sail 26 is hoisted up mast 24.

FIG. 2 shows a portion of mast 24 including widened slot region 30 and pre-feeder 32. Pre-feeder 32 has two opposing pinch members 40*a* and 40*b* that define an adjustable gap 41*a* for retaining, adjusting and/or releasing a luft rope and forward edge of main sail 26. Screw 42 is provided on one side of pre-feeder 32 for adjusting the dimension of gap 41*a*. A plate 44, shown in dashed lines, is secured by screw 45 to the front plate of pre-feeder 32 to secure pre-feeder 32 in the slot below widened slot region 30.

A perspective view of pre-feeder 32 is shown in FIG. 3. Hinge 48 allows repositioning of pinch member 40*b* in response to rotation of screw 42 while pinch member 40*a* remains fixed in relation to mast 24.

FIGS. 4 and 5 show how pre-feeder 32 may be adjusted between an "engaged" or "gripping" position (FIG. 4) and a "released" or "open" position (FIG. 5). In FIG. 4, screw 42 is screwed at least partially into female receptacle portion 49, impinging on a surface of mast 24, thereby moving pinch member 40*b* sufficiently close to pinch member 40*a* to retain the luft rope in pre-feeder 32, while allowing the forward edge of main sail 26 to slide easily through pre-feeder 32.

In contrast, FIG. 5 shows screw 42 mostly disengaged from female receptacle portion 49 allowing pinch member 40*b* to pivot around hinge 40, thereby defining a larger gap 41*b* between the pinch members to release the luft rope from pre-feeder 32.

Thus, when the pre-feeder is in its guiding position, it partially encompasses the luft rope while allowing the luft rope to slide through the partial enclosure of the clamp. The pre-feeder can be easily opened to allow quick removal of the luft rope, for example, if it is desired to quickly take down the main sail from a reefed or partially-hoisted sail. Alternatively, the pre-feeder can be easily re-engaged to the luft rope at any intermediate portion of the forward edge of the main sail when the sailor wants to raise the main sail. Another important advantage of the pre-feeder shown in FIGS. 1–5 is that the gap between pinch members can be optimized or tuned for a particular luft rope and main sail material dimension.

Many modifications of the pre-feeder design shown in FIGS. 1–5 may be used for similar purposes and are considered to be included within the scope of the invention. For example, a pre-feeder may be spring-biased toward a guiding position, and potentially pressured toward a release position. Pre-feeder 32 in FIGS. 1–5 uses a thumb screw. However, other mechanisms such as a spring-latch, slide bolt, or any other means may be used to hold the guides or pinch members in an engaged position. A stop mechanism may be used to stop the closing guide in the proper position. An allen screw may be used to allow easy adjustment of the guide stop. Thin spacers may be incorporated also for spacing adjustments. A rod with cotter pins or other similar pins may be used as an adjustor. Pinch members 40*a*, 40*b* may be any smooth rounded object that would fit or accommodate the luft rope's dimensions.

The pre-feeder design shown in FIGS. 1–5 is secured into the groove of the mast by one or more screws. However, the pre-feeder could also be attached to the mast by at least partially encircling or clamping the circumference of the mast.

FIG. 6 shows an alternative for a pre-feeder design according to another embodiment of the invention. Pre-feeder 60 includes base 62 which is connected to back plate member 64 by screw 66 in slot 67 of mast 68. Pinch member 69 is connected to base 62 in a fixed orientation. Pinch member 70 is connected to base 62 via hinge 72. Spring 74, shown in dashed lines, biases pinch member 70 toward pinch member 69 to define an appropriate gap distance for retaining a luft rope inside pre-feeder 60. If a sailor desires to remove the luft rope from pre-feeder 60, the sailor simply pulls the sail in a direction away from mast 68 with sufficient force to counter the force of spring 74, thereby opening pre-feeder 60 sufficiently to remove the luft rope. When the sailor wants to re-engage the luft rope with pre-feeder 60, the sailor pushes the luft rope in the outer neck portion 76 of pre-feeder 60 with sufficient force to cause pinch member 70 to rotate about the axis of hinge 72 so that the luft rope can re-enter the space of pre-feeder 60.

Figure 7:
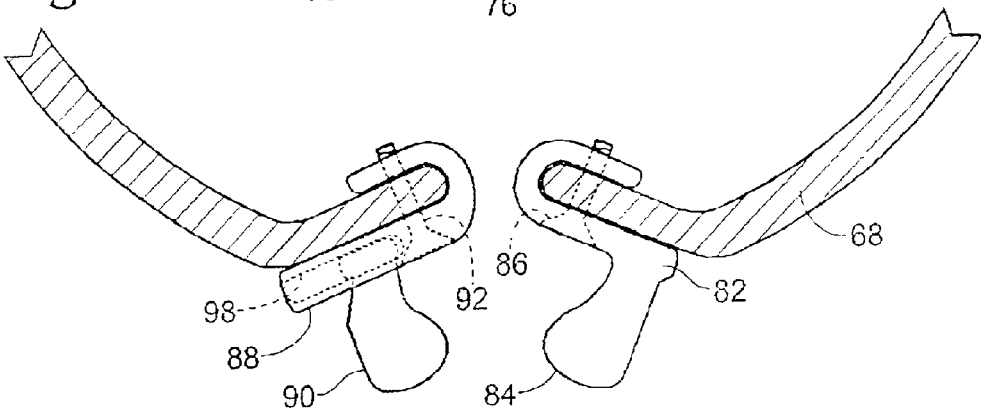
FIG. 7 shows a partial cross-sectional view of a mast and another pre-feeder embodiment.
Figure 8:
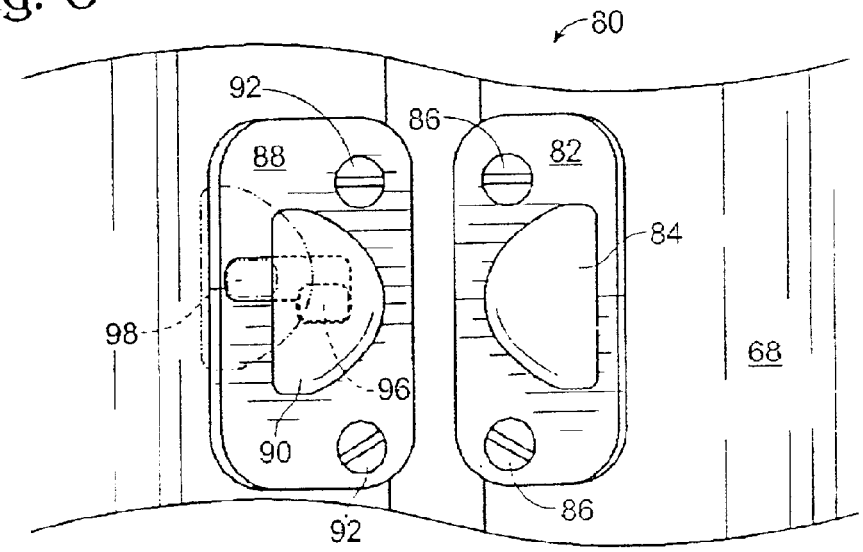
FIG. 8 shows a partial front view of the mast and pre-feeder shown in FIG. 7.

FIG. 7 shows another pre-feeder embodiment 80 which includes two separate pieces. First pre-feeder base member 82 is designed to clamp one edge of the groove in mast 68. Base member 82 has a fixed pinch member 84, and is attached to the mast by a pair of screws 86. On the other side of the groove, base member 88 includes pinch member 90. Base member 88 is secured to the mast by a pair of screws 92. In contrast to fixed base member 82, base member 88 has a slide mechanism permitting movement of pinch member 90 between two or more positions. As shown in FIG. 8, pinch member 90 has a pin 96 that may slide in slot 98 of base member 88. Slot 98 may have one or more notches. A spring may be provided to urge pin 96 into the one or more notches in slot 98.

A releasable or adjustable pre-feeder may be manufactured as follows. I obtained a non-adjustable pre-feeder made by the Spin-Loc Company. I found a quality stainless steel hinge with the proper proportions. Next, I sawed off one side of the Spin-Loc pre-feeder. I welded the hinge to the mounting plate and also to the sawed off guide. A stainless steel nut was welded to the hinge, and a thumb screw was screwed through the nut and positioned such that the end of the threaded bolt portion pressed against the mast, thus pressing the hinged portion closed against the "guide stop." The pre-feeder was configured so that the thumb screw would not rub against the sail.

While the present invention has been particularly shown and described with reference to the foregoing preferred embodiments, those skilled in the art will understand that many variations may be made therein without departing from the spirit and scope of the invention as defined in the following claims. The description of the invention should be understood to include all novel and non-obvious combinations of elements described herein, and claims may be presented in this or a later application to any novel and non-obvious combination of these elements. Where the claims recite "a" or "a first" element or the equivalent thereof, such claims should be understood to include incorporation of one or more such elements, neither requiring nor excluding two or more such elements.

I claim:

1. A pre-feeder for guiding a main sail into a slot on a sail boat mast, comprising first and second retention members mounted below the slot on the, sail boat mast, wherein the first and second retention members are spaced from each other by a distance small enough to retain a luft rope, but large enough to allow easy sliding of the main sail through the pre-feeder, an adjustment mechanism that permits alteration of the distance between the retention members so that the luft rope can be selectively released and re-engaged by the pre-feeder, at least one hinge connected to one of the retention members, and permitting the retention member to be repositioned, thereby altering the distance between the retention members, and a screw threaded through a collar so that location of the screw causes pivotal movement of one of the retention members around the hinge.

2. The pre-feeder of claim 1 further comprising a base and mechanism for mounting the base on the mast, each of the first and second retention members being connected to the base.

3. The pre-feeder of claim 1 further comprising a slide adjustment mechanism permitting at least one of the retention members to be moved relative to the other retention member, thereby adjusting the distance between the retention members.

4. The pre-feeder of claim 1, wherein the hinge is spring-biased toward a position for retaining the luft rope.

5. A pre-feeding apparatus for directing the luft rope of a sail into the keyway of a luft supporting member, comprising a first sail engaging element, a second sail engaging element, an adjustment mechanism which holds the first sail engaging element and the second sail engaging element in positions including an engaged position in which the first sail engaging element is set a fixed distance from the second sail engaging element, the fixed distance being greater than or equal to the thickness of the sail and less than the diameter of the luft rope, and an open position in which the distance between the first sail engaging element and the second sail engaging element is greater than the diameter of the luft rope, and wherein each sail engaging element includes a roller guide.

6. A pre-feeding apparatus in accordance with claim 5, wherein the position of the sail engaging elements is set with a thumbscrew.

7. A pre-feeding apparatus in accordance with claim 5, wherein the position of the sail engaging elements is set with a spring latch.

8. A pre-feeding apparatus in accordance with claim 5, wherein the position of the sail engaging elements is set with a slide bolt.

9. A pre-feeder for guiding a main sail into a slot on a sail boat mast, comprising first and second retention members mounted below the slot on the sail boat mast, wherein the first and second retention members are spaced from each other by a distance small enough to retain a luft rope, but large enough to allow easy sliding of the main sail through the pre-feeder, an adjustment mechanism that permits alteration of the distance between the retention members so that the luft rope can be selectively released and re-engaged by the pre-feeder, and wherein the first and second retention members are separately attached to the mast.

10. The pre-feeder of claim 9 further comprising a base and mechanism for mounting the base on the mast, each of the first and second retention members being connected to the base.

11. The pre-feeder of claim 9 further comprising a slide adjustment mechanism permitting at least one of the retention members to be moved relative to the other retention member, thereby adjusting the distance between the retention members.

12. The pre-feeder of claim 9, wherein the hinge is spring-biased toward a position for retaining the luft rope.

13. A pre-feeding apparatus for directing the luft rope of a sail into the keyway of a luft supporting member, comprising a first sail engaging element, a second sail engaging element, an adjustment mechanism which holds the first sail engaging element and the second sail engaging element in positions including an engaged position in which the first sail engaging element is set a fixed distance from the second sail engaging element, the fixed distance being greater than or equal to the thickness of the sail and less than the diameter of the luft rope, and an open position in which the distance between the first sail engaging element and the second sail engaging element is greater than the diameter of the luft rope, and wherein the position of the sail engaging elements is set with a slide bolt.

14. A pre-feeding apparatus in accordance with claim 13, wherein the first sail engaging element includes a smooth rounded guide.

* * * * *